US005304260A

United States Patent [19]

Aikawa et al.

[11] Patent Number: 5,304,260

[45] Date of Patent: Apr. 19, 1994

[54] HIGH STRENGTH MAGNESIUM-BASED ALLOYS

[75] Inventors: Kazuo Aikawa, Namerikawa; Katsuyuki Taketani, Kawasaki, both of Japan

[73] Assignee: Yoshida Kogyo K.K., Tokyo, Japan

[21] Appl. No.: 931,655

[22] Filed: Aug. 17, 1992

Related U.S. Application Data

[63] Continuation of Ser. No. 544,844, Jun. 27, 1990, abandoned.

[30] Foreign Application Priority Data

Jul. 13, 1989 [JP] Japan ..... 1-179139

[51] Int. Cl.[5] ..... C22C 45/00; C22C 23/02

[52] U.S. Cl. ..... 148/403; 148/420; 420/405; 420/407; 420/411

[58] Field of Search ..... 148/403, 406, 420; 420/402-414

[56] References Cited

U.S. PATENT DOCUMENTS

| | | | |
|---|---|---|---|
| 3,131,095 | 4/1964 | Hershey et al. | 148/420 |
| 3,147,156 | 9/1964 | Foerster | 148/406 |
| 3,183,083 | 5/1965 | Foerster | 148/420 |
| 4,401,621 | 8/1983 | Unsworth et al. | 148/420 |
| 4,675,157 | 6/1987 | Das et al. | 420/406 |
| 4,765,954 | 8/1988 | Das et al. | 148/420 |
| 4,770,850 | 9/1988 | Hehmann et al. | 420/402 |
| 4,853,035 | 8/1989 | Das et al. | 75/249 |
| 4,857,109 | 8/1989 | Das et al. | 75/249 |
| 4,886,557 | 12/1989 | Chadwick | 420/411 |
| 4,908,181 | 3/1990 | Das et al. | 420/405 |
| 4,938,809 | 7/1990 | Das et al. | 148/406 |
| 4,990,198 | 2/1991 | Masumoto et al. | 148/403 |
| 4,997,622 | 3/1991 | Regazzoni et al. | 420/407 |
| 5,073,207 | 12/1991 | Faure et al. | 420/407 |
| 5,078,807 | 1/1992 | Chang et al. | 148/406 |
| 5,087,304 | 2/1992 | Chang et al. | 148/406 |

FOREIGN PATENT DOCUMENTS

| | | |
|---|---|---|
| 124363 | 1/1946 | Australia . |
| 404271 | 5/1966 | Australia . |
| 406566 | 6/1968 | Australia . |
| 64294/72 | 1/1974 | Australia . |
| 497907 | 6/1978 | Australia . |
| 520669 | 12/1979 | Australia . |
| 534059 | 4/1981 | Australia . |
| 588665 | 8/1987 | Australia . |
| 1177624 | 11/1984 | Canada . |
| 0361136 | 4/1990 | European Pat. Off. . |
| 89-08154 | 9/1989 | PCT Int'l Appl. . |
| 2196986 | 5/1988 | United Kingdom . |

OTHER PUBLICATIONS

Khrussanova et al., "Calcium and Nickel-Substituted . . . Storage", J. of the Less Common Metals, v. 131, pp. 379-383, 1987.

Khrussanova et al., "Effect of Some . . . Kinetics", J. of Materials Science, v. 23, pp. 2247-2250, 1988.

Mizutani et al. "Electronic properties of Mg-based simple metallic glasses", Journal of Physics F, Metal Physics, vol. 14, No. 12, pp. 2995-3006, Dec. 1984.

Inoue et al., "New Amorphous Mg-Ce-Ni Alloys with High Strength and . . . ", Japanese Journal of Applied Physics, vol. 27, No. 12, pp. L. 2248-2251, Dec. 1988.

Inoue et al. "Magnesium-nickel-lanthanum amorphous alloys with a wide . . . ", Mater. Trans., JIM, vol. 30, No. 5, pp. 378-381, May 1989, Chem. Ab. #111:138538.

Rajasekharan et al., "The quasi-crystalline phase in the Mg-Al-Zn system", Nature, vol. 322, No. 6079, pp. 528-530, Aug. 1986.

*Primary Examiner*—George Wyszomierski

*Attorney, Agent, or Firm*—Flynn, Thiel, Boutell & Tanis

[57] ABSTRACT

The present invention provides high strength magnesium-based alloys which are composed a fine crystalline structure, the alloys having a composition represented by the general formula (I) $Mg_aX_b$; (II) $Mg_aX_cM_d$, (III) $Mg_aX_cLn_e$; or (IV) $Mg_aX_cM_dLn_e$ (wherein X is one or more elements selected from the group consisting of Cu, Ni, Sn and Zn; M is one or more elements selected from the group consisting of Al, Si and Ca; Ln is one or more elements selected from the group consisting of Y, La, Ce, Nd and Sm or a misch metal of rare earth elements; and a, b, c, d and e are atomic percentages falling within the following ranges: $40 \leqq a \leqq 95$, $5 \leqq b \leqq 60$, $1 \leqq c \leqq 35$, $1 \leqq d \leqq 25$ and $3 \leqq e \leqq 25$). Since the magnesium-based alloys have a superior combination of properties of high hardness, high strength and good processability, they are very useful in various industrial applications.

11 Claims, 1 Drawing Sheet

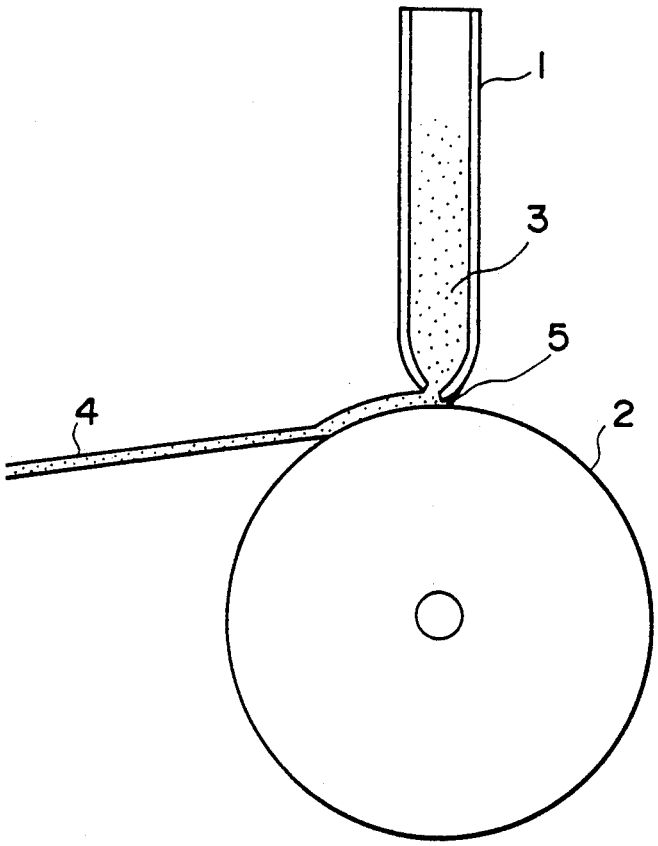
1
3
5
4
2

HIGH STRENGTH MAGNESIUM-BASED ALLOYS

This application is a continuation of U.S. Ser. No. 07/544 844, filed Jun. 27, 1990, now abandoned.

BACKGROUND OF THE INVENTION

1. Field of the Invention

The present invention relates to magnesium-based alloys which have a superior combination of high hardness and high strength and are useful in various industrial applications.

2. Description of the Prior Art

As conventional magnesium-based alloys, there have been known Mg-Al, Mg-Al-Zn, Mg-Th-Zr, Mg-Th-Zn-Zr, Mg-Zn-Zr, Mg-Zn-Zr-RE (rare earth element), etc. and these known alloys have been extensively used in a wide variety of applications, for example, as light-weight structural component materials for aircrafts and automobiles or the like, cell materials and sacrificial anode materials, according to their properties.

However, conventional magnesium-based alloys, as set forth above, have a low hardness and strength and are also poor in corrosion resistance.

SUMMARY OF THE INVENTION

In view of the foregoing, it is an object of the present invention to provide novel magnesium-based alloys at a relatively low cost which have an advantageous combination of properties of high hardness and strength and which are readily processable, for example, by extrusion.

According to the present invention, there are provided the following high strength magnesium-based alloys:

(1) High strength magnesium-based alloys which are composed of a fine crystalline structure, the magnesium-based alloys having a composition represented by the general formula (I):

$$Mg_aX_b \qquad (I)$$

wherein:

X is at least two elements selected from the group consisting of Cu, Ni, Sn and Zn; and a and b are atomic percentages falling within the following ranges:

$40 \leqq a \leqq 95$ and $5 \leqq b \leqq 60$.

(2) High strength magnesium-based alloys which are composed of a fine crystalline structure, the magnesium-based alloys having a composition represented by the general formula (II):

$$Mg_aX_cM_d \qquad (II)$$

wherein:

X is one or more elements selected from the group consisting of Cu, Ni, Sn and Zn;

M is one or more elements selected from the group consisting of Al, Si and Ca; and a, c and d are atomic percentages falling within the following ranges:

$40 \leqq a \leqq 95$, $1 \leqq c \leqq 35$ and $1 \leqq d \leqq 25$.

(3) High strength magnesium-based alloys which are composed of a fine crystalline structure, the magnesium-based alloys having a composition represented by the general formula (III):

$$Mg_aX_cLn_e \qquad (III)$$

wherein:

X is one or more elements selected from the group consisting of Cu, Ni, Sn and Zn; Ln is one or more elements selected from the group consisting of Y, La, Ce, Nd and Sm or a misch metal (Mm) which is a combination of rare earth elements; and a, c and e are atomic percentages falling within the following ranges:

$40 \leqq a \leqq 95$, $1 \leqq c \leqq 35$ and $3 \leqq e \leqq 25$.

(4) High strength magnesium-based alloys which are composed of a fine crystalline structure, the magnesium-based alloys having a composition represented by the general formula (IV):

$$Mg_aX_cM_dLn_e \qquad (IV)$$

wherein:

X is one or more elements selected from the group consisting of Cu, Ni, Sn and Zn;

M is one or more elements selected from the group consisting of Al, Si and Ca;

Ln is one or more elements selected from the group consisting of Y, La, Ce, Nd and Sm or a misch metal (Mm) which is a combination of rare earth elements; and a, c, d and e are atomic percentages falling within the following ranges:

$40 \leqq a \leqq 95$, $1 \leqq c \leqq 35$, $1 \leqq d \leqq 25$ and $3 \leqq e \leqq 25$.

The expression "fine crystalline structure" is used herein to mean an alloy structure consisting of a supersaturated solid solution, a stable or metastable intermetallic phase or mixed phases thereof. Among the elements included in the above-defined alloy compositions, La, Ce, Nd and/or Sm may be replaced with a misch metal (Mm), which is a composite containing those rare earth elements as main components. The Mm used herein consists of 40 to 50 atomic % Ce and 20 to 25 atomic % La with other mere earth elements and acceptable levels of impurities (Mg, Al, Si, Fe, etc). Mm may be replaced for the other Ln elements in an about 1:1 ratio (by atomic %) and provides an economically advantageous effect as a practical source of the Ln element because of its low cost.

BRIEF DESCRIPTION OF THE DRAWING

The single figure is a schematic illustration of a single-roller melt-spinning apparatus employed to prepare thin ribbons from the alloys of the present invention by a rapid solidification process.

DETAILED DESCRIPTION OF THE PREFERRED EMBODIMENTS

The magnesium-based alloys of the present invention can be obtained by rapidly solidifying a melt of an alloy having the composition as specified above by means of liquid quenching techniques. The liquid quenching techniques involve rapidly cooling a molten alloy and, particularly, single-roller melt-spinning, twin-roller melt-spinning and in-rotating-water melt-spinning are mentioned as especially effective examples of such techniques. In these techniques, a cooling rate of about $10^3$ to $10^5$ K/sec can be obtained. In order to produce thin ribbon materials by single-roller melt-spinning, twin-roller melt-spinning or the like, the molten alloy is ejected from the opening of a nozzle on to a roll of, for example, copper or steel, with a diameter of about 30–3000 mm, which is rotating at a constant rate of about 300–10000 rpm. In these techniques, various thin ribbon materials with a width of about 1–300 mm and a thickness of about 5–500 μm can be readily obtained. Alternatively, in order to produce fine wire materials by the in-rotating-water melt-spinning technique, a jet of the molten alloy is directed, under application of a back pressure of argon gas, through a nozzle into a liquid refrigerant layer with a depth of about 1 to 10 cm which is held by centrifugal force in a drum rotating at a rate of about 50 to 500 rpm. In such a manner, fine wire materials can be readily obtained. In this technique, the angle between the molten alloy ejecting from the nozzle and the liquid refrigerant surface is preferably in the range of about 60° to 90° and the ratio of the relative velocity of the ejecting molten alloy to the liquid refrigerant surface is preferably in the range of about 0.7 to 0.9.

The alloys of the present invention are prepared at a cooling rate on the order of about $10^3$ to $10^5$ K/sec. When the cooling rate is lower than $10^3$ K/sec, it is impossible to obtain fine crystalline structure alloys having the properties contemplated by the present invention. On the other hand, cooling rates exceeding $10^5$ K/sec provides an amorphous structure or a composite structure of an amorphous phase and a fine crystalline phase. For this reason, the above specified cooling rate is employed in the present invention.

However, the fine crystalline structure alloy of the present invention may be also prepared by forming first an amorphous alloy in the same procedure as described above, except employing cooling rates of $10^4$ to $10^6$ K/sec, and, then, heating the amorphous alloy to the vicinity of its crystallization temperature (crystallization temperature ±100° C.), thereby causing crystallization. In some alloy compositions, the intended fine crystalline structure alloys can be produced at temperatures lower than 100° C. less than their crystallization temperature −100° C.

Besides the above techniques, the alloy of the present invention can also be obtained in the form of a thin film by a sputtering process. Further, rapidly solidified powder of the alloy composition of the present invention can be obtained by various atomizing processes such as, for example, high pressure gas atomizing or spray deposition.

In the magnesium-based alloys of the present invention represented by the above general formula (I), a is limited to the range of 40 to 95 atomic % and b is limited to the range of 5 to 60 atomic %. The reason for such limitations is that when the content of Mg is lower than the specified lower limit, it is difficult to form a supersaturated solid solution containing solutes therein in amounts exceeding their solid solubility limits. Therefore, fine crystalline structure alloys having the properties contemplated by the present invention can not be obtained by industrial rapid cooling techniques using the above-mentioned liquid quenching, etc. On the other hand, if the content of Mg exceeds the specified upper limit, it is impossible to obtain fine crystalline structure alloys having the properties intended by the present invention.

In the magnesium-based alloys of the present invention represented by the above general formula (II), a, c and d are limited to the ranges of 40 to 95 atomic %, 1 to 35 atomic % and 1 to 25 atomic %, respectively. The reason for such limitations is that when the content of Mg is lower than the specified lower limit, it becomes difficult to form the supersaturated solid solution with the solutes dissolved therein in amounts exceeding solid solubility limits. Therefore, the fine crystalline structure alloys having the properties contemplated by the present invention can not be obtained by industrial rapid cooling techniques using the above-mentioned liquid quenching, etc. On the other hand, if the content of Mg exceeds the specified upper limit, it is impossible to obtain the fine crystalline structure alloys having the properties intended by the present invention.

In the magnesium-based alloys of the present invention represented by the above general formula (III), a is limited to the range of 40 to 95 atomic %, c is limited to the range of 1 to 35 atomic % and e is limited to the range of 3 to 25 atomic %. As described above, the reason for such limitations is that when the content of Mg is lower than the specified lower limit, it becomes difficult to form the supersaturated solid solution with the solutes dissolved therein in amounts exceeding their solid solubility limits. Therefore, fine crystalline alloys having the properties contemplated by the present invention can not be obtained by industrial rapid cooling techniques using the above-mentioned liquid quenching, etc. On the other hand, if the content of Mg exceeds the specified upper limit, it is impossible to obtain fine crystalline structure alloys having the properties intended by the present invention.

Further, in the magnesium-based alloys of the present invention represented by the above general formula (IV), a, c, d and e should be limited within the ranges of 40 to 95 atomic %, 1 to 35 atomic %, 1 to 25 atomic % and 3 to 25 atomic %, respectively. The reason for such limitations is, as described above, that when the content of Mg is lower than the specified lower limit, it becomes difficult to form the supersaturated solid solution with solutes dissolved therein in amounts exceeding their solid solubility limits. Therefore, the fine crystalline structure alloys having the properties contemplated by the present invention can not be obtained by industrial rapid cooling techniques using the above-mentioned liquid quenching, etc. On the other hand, if the content of Mg exceeds the specified upper limit, it is impossible to obtain fine crystalline structure alloys having the properties intended by the present invention.

The X element is one or more elements selected from the group consisting of Cu, Ni, Sn and Zn and these elements provide a superior effect in stabilizing the resulting crystalline phase, under the conditions of the preparation of the fine crystalline structure alloys, and improve the alloy's strength while retaining its ductility.

The M element is one or more elements selected from the group consisting of Al, Si and Ca and forms stable or metastable intermetallic compounds in combination with magnesium and other additive elements under the production conditions of the fine crystalline structure alloys. The formed intermetallic compounds are uniformly distributed throughout a magnesium matrix (α-phase) and, thereby, considerably improve the hardness and strength of the resultant alloys. Further, the M element prevents coarsening of the fine crystalline structure at high temperatures and provides a good heat resistance. Among the above elements, Al element and Ca element have the effect of improving the corrosion resistance and Si element improves the fluidity of the molten alloy.

The Ln element is one or more elements selected from the group consisting of Y, La, Ce, Nd and Sm or a misch metal (Mm) consisting of rare earth elements and the Ln element is effective to provide a more stable, fine crystalline structure, when it is added to the Mg-X system or the Mg-X-M system. Further, the Ln element provides a greatly improved hardness.

Further, since the magnesium-based alloys of the present invention, show superplasticity at a high temperature range, permitting the presence of a stable fine crystalline phase, they can be readily subjected to extrusion, press working, hot forging, etc. Therefore, the magnesium-based alloys of the present invention, obtained in the form of thin ribbon, wire, sheet or powder, can be successfully consolidated into bulk materials by way of extrusion, press working, hot-forging, etc., at the high temperature range for a stable, fine crystalline phase. Further, some of the magnesium-based alloys of the present invention are sufficiently ductile to permit a high degree of bending.

Example

Molten alloy 3, having a predetermined composition, was prepared using a high-frequency melting furnace and charged into a quartz tube 1 having a small opening 5 (diameter: 0.5 mm) at the tip thereof, as shown in the drawing. After being heated to melt the alloy 3, the quartz tube 1 was disposed right above a copper roll 2. Then, the molten alloy 3 contained in the quartz tube 1 was ejected from the small opening 5 of the quartz tube 1 under the application of an argon gas pressure of 0.7 $kg/cm^2$ and brought into contact with the surface of the copper roll 2 rapidly rotating at a rate of 5,000 rpm. The molten alloy 3 was rapidly solidified and an alloy thin ribbon 4 was obtained.

According to the processing conditions as described above, there were obtained 21 different alloy thin ribbons (width: 1 mm, thickness: 20 μm) having the compositions (by at. %) as shown in the Table. Hardness (Hv) and tensile strength were measured for each test specimen of the thin ribbons and the results are shown in a right column of the Table.

The hardness (Hv) is indicated by values (DPN) measured using a Vickers micro hardness tester under a load of 25 g.

As shown in the Table, all test specimens showed a high level of hardness Hv (DPN) of at least 240 which is about 2.5 to 4.0 times the hardness Hv (DPN), i e., 60–90, of the conventional magnesium-based alloys. Further, the test specimens of the present invention all exhibited a high tensile-strength level of not less than 850 MPa and such a high strength level is approximately 2 times the highest strength level of 400 MPa achieved in known magnesium-based alloys. It can be seen from such results that the alloy materials of the present invention are superior in hardness and strength.

In addition, for example, specimen Nos. 3, 7 and 12 shown in the Table exhibited a superior ductility permitting a large degree of bending and a good formability.

TABLE

| No. | Specimen | Hv(DPN) | δf (MPa) |
|---|---|---|---|
| 1. | $Mg_{65}Ni_{25}La_{10}$ | 325 | 1150 |
| 2. | $Mg_{90}Ni_5La_5$ | 295 | 1010 |
| 3. | $Mg_{90}Ni_5Ce_5$ | 249 | 920 |
| 4. | $Mg_{75}Ni_{10}Y_{15}$ | 346 | 1280 |
| 5. | $Mg_{75}Ni_{10}Si_5Ce_{10}$ | 302 | 1100 |
| 6. | $Mg_{75}Ni_{10}Mm_{15}$ | 295 | 1120 |
| 7. | $Mg_{90}Ni_5Mm_5$ | 270 | 920 |
| 8. | $Mg_{60}Ni_{20}Mm_{20}$ | 357 | 1150 |
| 9. | $Mg_{70}Ni_{10}Ca_5Mm_{15}$ | 313 | 1180 |

TABLE-continued

| No. | Specimen | Hv(DPN) | δf (MPa) |
|---|---|---|---|
| 10. | $Mg_{70}Ni_5Al_5Mm_{20}$ | 346 | 1260 |
| 11. | $Mg_{55}Ni_{20}Sn_{10}Y_{15}$ | 355 | 1215 |
| 12. | $Mg_{90}Cu_5La_5$ | 246 | 872 |
| 13. | $Mg_{80}Cu_{10}La_{10}$ | 266 | 935 |
| 14. | $Mg_{50}Cu_{20}La_{10}Ce_{20}$ | 327 | 1160 |
| 15. | $Mg_{75}Cu_{10}Zn_5La_{10}$ | 346 | 1195 |
| 16. | $Mg_{75}Cu_{15}Mm_{10}$ | 265 | 877 |
| 17. | $Mg_{80}Cu_{10}Y_{10}$ | 274 | 901 |
| 18. | $Mg_{75}Cu_{10}Sn_5Y_{10}$ | 352 | 1150 |
| 19. | $Mg_{70}Cu_{12}Al_8Y_{10}$ | 307 | 1180 |
| 20. | $Mg_{80}Sn_{10}La_{10}$ | 291 | 1087 |
| 21. | $Mg_{70}Zn_{15}La_{10}Ce_5$ | 304 | 1125 |

As described above, the magnesium-based alloys of the present invention have a high hardness and a high strength which are respectively, at least 2.5 times and at least 2 times greater than those of a similar type of magnesium-based alloy which has been heretofore evaluated as the most superior alloy and yet also have a good processability permitting extrusion or similar operations. Therefore, the alloys of the present invention exhibit advantageous effects in a wide variety of industrial applications.

What is claimed is:

1. A high strength magnesium-containing alloy consisting essentially of a fine crystalline structure of a supersaturated solid solution comprising a magnesium matrix; or a mixed phase of a magnesium matrix phase and a stable or metastable intermetallic phase, said fine crystalline structure having been formed by cooling at a rate of from $10^3$ to $10^5$ degrees K/sec and said magnesium-containing alloy consisting of a composition represented by the general formula (I):

$$Mg_aX_b \qquad (I)$$

wherein:

X is at least two elements selected from the group consisting of Cu, Ni, Sn and Zn; and a and b are atomic percentages falling within the following ranges:

$40 \leqq a \leqq 95$ and $5 \leqq b \leqq 60$.

2. The high strength magnesium containing alloy of claim 1, wherein the magnesium matrix, matrix phase and stable or metastable intermetallic phase have a mean grain size of 10 nm to 1000 nm.

3. A high strength magnesium-containing alloy consisting essentially of a fine crystalline structure of a supersaturated solid solution comprising a magnesium matrix; or a mixed phase of a magnesium matrix phase and a stable or metastable intermetallic phase, said fine crystalline structure having been formed by cooling at a rate of from $10^3$ to $10^5$ degrees K/sec and said magnesium-containing alloy consisting of a composition represented by the general formula (II):

$$Mg_aX_cM_d \qquad (II)$$

wherein:

X is one or more elements selected from the group consisting of Cu, Ni, Sn and Zn;

M is Ca; and a, c and d are atomic percentages falling within the following ranges:

$40 \leqq a \leqq 91$, $5 \leqq c \leqq 35$ and $1 \leqq d \leqq 25$.

4. The high strength magnesium containing alloy of claim 3, wherein the magnesium matrix, matrix phase and stable or metastable intermetallic phase have a mean grain size of 10 nm to 1000 nm.

5. A high strength magnesium-containing alloy consisting essentially of a fine crystalline structure of a supersaturated solid solution comprising a magnesium matrix; or a mixed phase of a magnesium matrix phase and a stable or metastable intermetallic phase, said fine crystalline structure having been formed by cooling at a rate of from $10^3$ to $10^5$ degrees K/sec and said magnesium-containing alloy consisting of a composition represented by the general formula (III):

$$Mg_aX_cLn_e \quad (III)$$

wherein:

X is one or more elements selected from the group consisting of Cu, Sn and Zn;

Ln is one or more elements selected from the group consisting of Y, La, Ce, Nd and Sm or a misch metal (Mm) which is a combination of rare earth elements; and a, c and e are atomic percentages falling within the following ranges:

$40 \leqq a \leqq 91$, $5 \leqq c \leqq 35$ and $3 \leqq e \leqq 25$.

6. The high strength magnesium-containing alloy of claim 5, wherein said alloy is $Mg_{75}Cu_{10}Zn_5La_{10}$.

7. The high strength magnesium-containing alloy of claim 5, wherein said alloy is $Mg_{75}Cu_{10}Sn_5Y_{10}$.

8. The high strength magnesium containing alloy of claim 5, wherein the magnesium matrix, matrix phase and stable or metastable intermetallic phase have a mean grain size of 10 nm to 1000 nm.

9. A high strength magnesium-containing alloy consisting essentially of a fine crystalline structure of a supersaturated solid solution comprising a magnesium matrix; or a mixed phase of a magnesium matrix phase and a stable or metastable intermetallic phase, said fine crystalline structure having been formed by cooling at a rate of from $10^3$ to $10^5$ degrees K/sec and said magnesium-containing alloy consisting of a composition represented by general formula (IV):

$$Mg_aX_cM_dLn_e \quad (IV)$$

wherein:

(1) X is at least one element selected from the group consisting of Cu, Sn and Zn;

M is at least one element selected from the group consisting of Si and Ca;

Ln is at least one element selected from the group consisting of Y, La, Ce, Nd, Sm and Mm (misch metal), and a, c, d and e are, in atomic percent, $40 \leqq a \leqq 91$, $5 \leqq c \leqq 35$, $1 \leqq d \leqq 25$ and $3 \leqq e \leqq 25$, respectively;

(2) X is at least one element selected from the group consisting of Cu, Ni and Sn;

M is Al;

Ln is at least one element selected from the group consisting of Y, La, Ce, Nd, Sm and Mm (misch metal); and a, c, d and e are, in atomic percent, $40 \leqq a \leqq 91$, $5 \leqq c \leqq 35$, $1 \leqq d \leqq 25$ and $3 \leqq e \leqq 25$, respectively;

(3) X is at least one element selected from the group consisting of Cu, Ni, Sn and Zn;

M is Al and at least one element selected from the group consisting of Si and Ca;

Ln is at least one element selected from the group consisting of Y, La, Ce, Nd, Sm and Mm (misch metal), and a, c, d and e are, in atomic percent, $40 \leqq a \leqq 91$, $5 \leqq c \leqq 35$, $1 \leqq d \leqq 25$ and $3 \leqq e \leqq 25$, respectively; or (4) X is Zn and at least one element selected from the group consisting of Cu, Ni and Sn;

M is at least one element selected from the group consisting of Al, Si and Ca;

Ln is at least one element selected from the group consisting of Y, La, Ce, Nd, Sm and Mm (misch metal), and a, c, d and e are, in atomic percent, $40 \leqq a \leqq 91$, $5 \leqq c \leqq 35$, $1 \leqq d \leqq 25$ and $3 \leqq e \leqq 25$, respectively.

10. The high strength magnesium-containing alloy of claim 9, wherein said alloy is $Mg_{70}Ni_5Al_5Mm_{20}$.

11. The high strength magnesium-containing alloy of claim 9, wherein the magnesium matrix, matrix phase and stable or metastable intermetallic phase have a mean grain size of 10 nm to 1000 nm.

* * * * *